United States Patent [19]

Petry et al.

[11] 4,102,171

[45] Jul. 25, 1978

[54] LOAD TRANSFER BLOCK FOR ROLLING MILLS

[75] Inventors: Henry Alfred Petry, Sparta; William I. deVersterre, Warren, both of N.J.

[73] Assignee: Marotta Scientific Controls, Inc., Boonton, N.J.

[21] Appl. No.: 806,068

[22] Filed: Jun. 13, 1977

[51] Int. Cl.[2] ..... B21B 31/00

[52] U.S. Cl. ..... 72/245

[58] Field of Search ..... 72/237, 245, 246

[56] References Cited

U.S. PATENT DOCUMENTS

| | | | |
|---|---|---|---|
| 3,124,982 | 3/1964 | Neumann | 72/245 |
| 3,490,256 | 1/1970 | O'Brien | 92/245 |
| 3,550,413 | 12/1970 | Bornikel | 72/245 |

FOREIGN PATENT DOCUMENTS

| | | | |
|---|---|---|---|
| 1,539,437 | 8/1968 | France | 72/245 |

*Primary Examiner*—Milton S. Mehr

*Attorney, Agent, or Firm*—Roy C. Hopgood; John M. Calimafde; Charles W. Neill

[57] ABSTRACT

In sheet-rolling mills where the rolls are normally under maximum rolling pressure, the mill is said to be "pre-stressed." Load transfer blocks exert a force to relieve a part of the pre-stress for each particular strip rolling operation. This invention has a combination of hydraulic pressure and gas pressure for providing a controlled substantially unyielding force during a rolling operation, and a yielding shock absorber for preventing full pre-stress load from coming on the rolls when an end of the strip passes the rolls or when a strip breaks.

13 Claims, 3 Drawing Figures

LOAD TRANSFER BLOCK FOR ROLLING MILLS

BACKGROUND AND SUMMARY OF THE INVENTION

Pre-stressed rolling mills which maintain maximum loading on the working rolls are provided with load transfer blocks having hydraulic motors for acting against the pre-stress loading to obtain the desired loading on the working rolls for a particular rolling operation.

More uniform rolling results are obtained if the load transfer blocks are incompressible, or as nearly so as possible, so that any movement of the rolls that would produce a gap larger than the transfer blocks provide for will subject the rolls to the full pre-stress force and thus prevent variations in the thickness of the sheet.

If a sheet breaks or the end of a sheet or strip quickly moves beyond the rolls so that the material being rolled no longer takes any of the pre-stress of the mill, the transfer blocks are subject to violent shock loading as the full pre-stress force of the mill comes upon them. In order to prevent such shock, this invention provides substantially incompressible transfer blocks with shock absorbers that come into action when the load rises above a certain predetermined force. This shock absorbing action is obtained by having a compressible gas which holds the shock-absorbing section of the transfer block rigid during normal operation; and which absorbs the shock when a workpiece moves beyond the pass between the working rolls.

The preferred embodiment of the invention provides a hydraulic motor, with a minimum of oil in it to make the block substantially incompressible, and a second motor subject to gas pressure and exerting a force that yields when the transfer block is subjected to excessive pressure.

One feature of the preferred embodiment is that gas pressure acts against a larger area so that it can hold the hydraulic motor in position, even though the hydraulic pressure is greater than the gas pressure.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
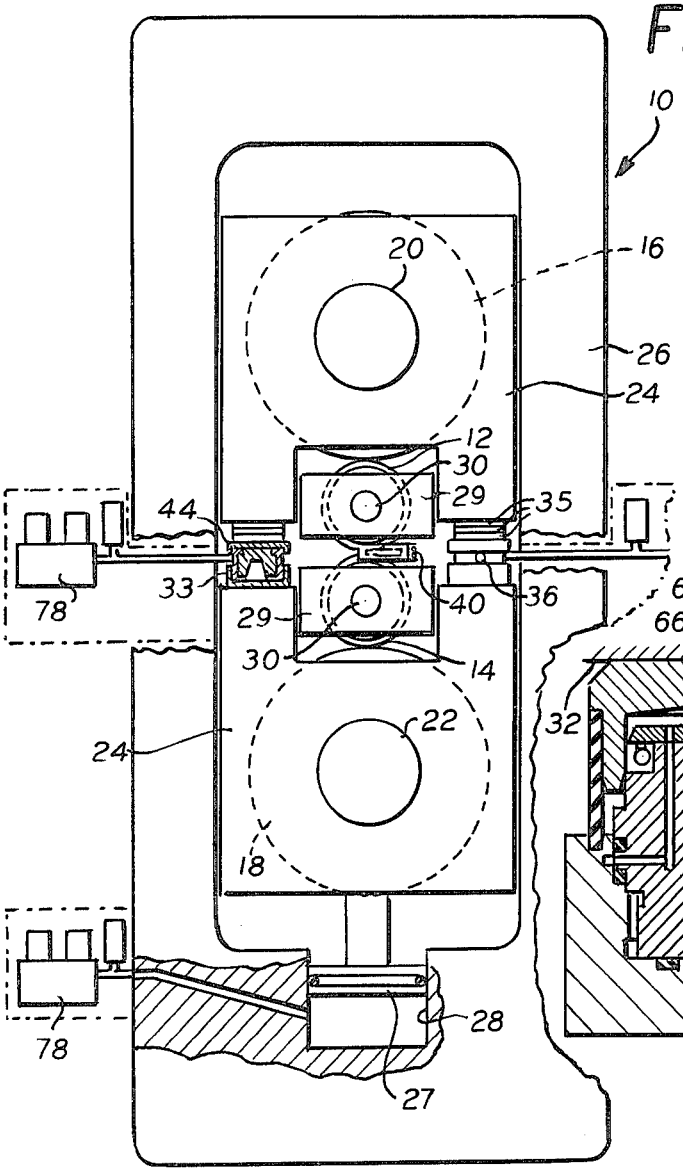
FIG. 1 is a diagrammatic view of a four-high rolling mill equipped with the shock-absorbing transfer blocks of this invention.

FIG. 1 shows a rolling mill 10 equipped with working rolls 12 and 14 which are urged into contact with one another by back-up rolls 16 and 18. The back-up rolls 16 and 18 have necks 20 and 22 carried by blocks 24 which are movable up and down in a main frame 26 of the rolling mill.

The lower block 24, which carries the neck 22 of the back-up roll 18, is urged upwardly by a piston 27 of a hydraulic motor 28 at the bottom of the frame 26, and the force exerted by this hydraulic motor 28 holds the rolls in contact with one another under substantial pressure and stretches the frame 26 so that the tension in the frame prestresses the mill even though there is no workpiece between the working rolls 12 and 14.

The working rolls 12 and 14 have necks 30 at their opposite ends, which extend into blocks 29. There is a load transfer block 36 which has hydraulic motors 42, one of which is shown diagrammatically in FIG. 1. These hydraulic motors 42 urge the blocks 35 and 33 apart so as to reduce the pressure of the rolls 12 and 14 against one another. Thus part of the pre-stress loading on the rolls 12 and 14 is relieved by the motors 42 of the load transfer blocks.

Depending upon the amount of roll gap desired, shims 35 can be used between the load transfer blocks and the final adjustment is provided by the hydraulic motors 42.

A roll gap sensor 40 moves in accordance with variations in the roll gap and operates control mechanism to change the pressure exerted by the motors 42 as necessary to obtain a uniform thickness of the workpiece being rolled. Such control mechanism forms no part of the present invention, and the novel construction of the transfer block is illustrated in FIGS. 2 and 3.

Figure 2:
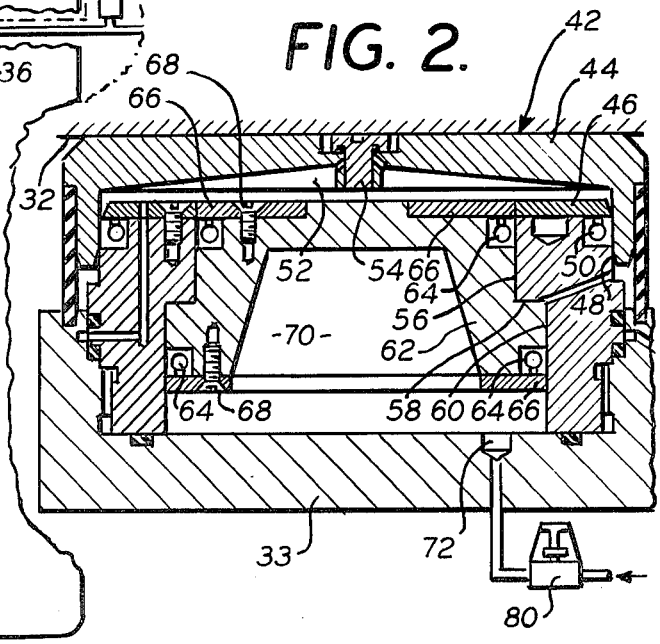
FIG. 2 is a greatly enlarged sectional view through one of the transfer block motors, which is shown diagrammatically in FIG. 1.
Figure 3:
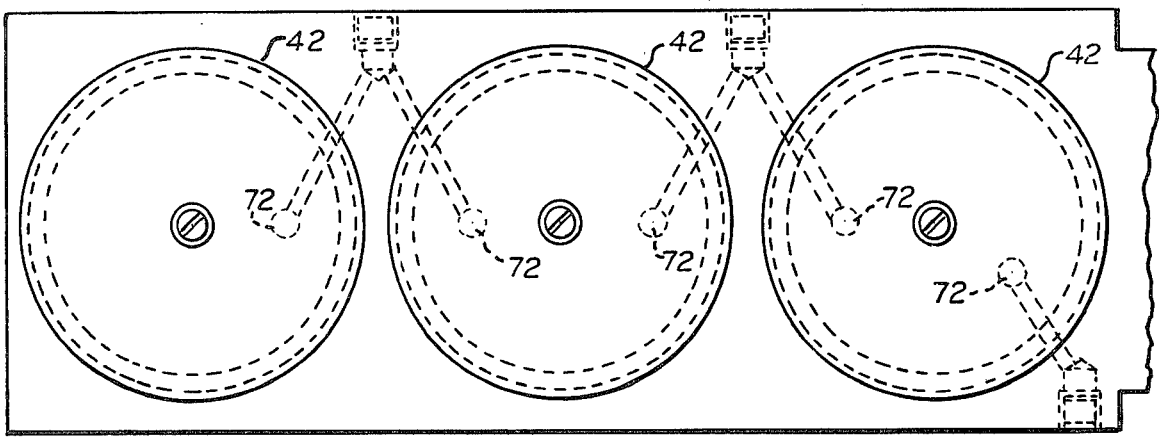
FIG. 3 is a diagrammatic top plan view of one of the load transfer blocks for the mill shown in FIG. 1, the scale being larger than that of FIG. 1 but smaller than that of FIG. 2.

The load transfer block shown in FIG. 2 has motor structure located in the block 33. In order to conserve space, there are a plurality of individual motors 42 located along the length of the block 33; and the construction of each motor is similar to that shown in FIG. 2.

The motor 42 includes a cylinder head 44 which is pressed against the shim 35 by hydraulic fluid between the cylinder head 44 and a fixed section 46. A cylinder wall 48 extends downward from the cylinder head 44, and there is a seal 50 for preventing escape of hydraulic fluid from the space enclosed by the cylinder head 44 and the section 46.

While hydraulic fluid is generally considered incompressible, it is not entirely so. For this reason, the motors 42 are made with a minimum of stroke, and this makes them operate with as small a volume of oil as possible. The preferred construction has a stroke, for the motor 42, of ½ inch or less. The lower face of the cylinder head 44 which confronts the section 46 is made parallel with the flat surface of the section 46 throughout substantially its entire area. However, there are angularly spaced grooves 52 in the inner face of the cylinder head 42 leading to a plug 54 which is open when the motor 42 is initially filled with oil; and the grooves 52 provide outlets for bleeding all air from the inside of the motor 42.

The section 46 is annular, and it has an inner wall 56 which provides an inner cylinder for the motor 42.

This inner cylinder wall 56 increases in diameter at a shoulder 58 and then extends downward with a lower cylindrical portion 60 which is concentric with the upper part of the wall 56.

A movable piston 62 is located within the cylinder provided by the walls 56 and 60; and this cylinder 62 has a step or shoulder confronting the shoulder 58 and in contact with the shoulder 58 in FIG. 2. The piston 62 is, therefore, at the upper end of its stroke, as shown in FIG. 2.

There are seals 64 extending around the upper and lower ends of the piston 62. These seals 64 serve as continuous piston rings at both the upper and lower ends of the piston. The seals 64 are held in recesses in the piston 62 by plates 66 attached to the upper and lower ends of the piston 62 by angularly spaced screws 68, two of which are shown in FIG. 2.

When the piston 62 is in contact with the step or shoulder 58, the upper end of the piston is flush with the top surface of the fixed annular piston 46.

There is space 70 within the piston 62, and in the cylinder 56 below the piston 62. Gas under pressure is admitted into the space 70 through a gas inlet passage 72. This gas is under sufficient pressure to hold the piston 62 in contact with the shoulder 58, and thereby maintain the top of the piston 62 flush with the top of the annular section 46, as long as the pressure against the top of the cylinder head 44 does not exceed the transfer block pressure for which the rolling mill is adjusted when working on any particular workpiece. The gas pressure for holding the piston 62 flush with the fixed section 46 can be at lower pressure than that of the hydraulic fluid in the motor 42, because the area of the piston 62, which is exposed to gas pressure, is greater than the area which is exposed to the pressure of the hydraulic fluid in the motor 42. This is because of the increase in diameter at the shoulder 58.

When the hydraulic motor 42 is subject to a sudden increase in pressure, as when the end of a workpiece passes beyond the working rolls, or a workpiece breaks so that there is no longer any of it between the working rolls, the increase in hydraulic fluid pressure in the motor 42 pushes the piston 62 downward so that the upper end of the piston 62 is no longer flush with the upper end of the annular piston 46. This leaves a space in the cylinder 56 above the piston 62 into which hydraulic fluid of the motor 42 can escape so that the cylinder head 44 can move downward against the compressible force of the gas under the piston 62. This cylindrical space above the piston 62, into which the hydraulic fluid escapes is, in effect, a chamber for holding hydraulic fluid; and the upper end of the piston 62, above the upper seal 64, is an obstruction which prevents escape of hydraulic fluid into the chamber so long as the motor 42 is not subject to excessive pressure.

It is a feature of the construction that the volume of compressible gas in the space 70 and below the piston 62 and in the inlet passage 72 is substantially greater than the volume of hydraulic fluid in the hydraulic motor 42. This permits the gas to compress with only a moderate rise in pressure and thus absorb the shock which would otherwise be a hammer blow against the transfer block motors 42.

Oil pressure for pre-stressing the mill 10 is shown diagrammatically in FIG. 1 and indicated by the reference character 76. The pressure is adjustable by conventional means, the illustration of which is unnecessary for a complete understanding of this invention. Similarly, other hydraulic fluid supply means 78 are provided for supplying hydraulic fluid to the transfer block motors 42 at adjustable pressures, depending upon how much of the pre-stress loading of the mill must be counteracted for a particular rolling operation.

FIG. 2 shows a pressure regulator 80 which is adjustable to supply gas to the space 70 at whatever pressure is needed to hold the piston 62 against the shoulder 58 as long as pressure in the hydraulic motor 42 does not become excessive.

FIG. 3 shows the way in which three motors 42 are located on each side of the transfer blocks and supplied with gas through manifolds 72.

The preferred embodiment of the invention has been illustrated and described, but changes and modifications can be made and some features can be used in different combinations without departing from the invention as defined in the claims.

What is claimed is:

1. Apparatus comprising a load transfer block for a prestressed rolling mill including a hydraulic motor having a cylinder, a piston in the cylinder, the cylinder and piston having relative movement with respect to one another, a chamber into which the hydraulic fluid in the cylinder can flow in the event of excessive loading on the hydraulic motor, an obstruction for preventing access of the hydraulic fluid to the chamber during normal operation of the hydraulic motor, a surface exposed to gas pressure for holding the obstruction in position to prevent escape of hydraulic fluid from the motor cylinder during normal loading of the hydraulic motor, the gas pressure being correlated with the intended maximum load on the motor for displacement of the obstruction when the motor is subjected to substantial overload.

2. The apparatus described in claim 1 characterized by adjustable means for controlling the pressure of the hydraulic fluid and the gas.

3. The apparatus described in claim 2 characterized by the means for controlling the pressure of the hydraulic fluid being sufficient to relieve the prestress of the mill to the pressure required for rolling to a desired thickness the work with which the mill is to be used, and the gas pressure being high enough to hold the obstruction against movement by the hydraulic pressure that relieves the mill of the prestress as required for the particular rolling operation to be performed by the mill, the gas being limited in pressure and volume so as to yield at the end of a workpiece, or upon breaking of a workpiece, which would otherwise cause the full prestress of the mill to come instantaneously on the hydraulic motor without the shock absorbing that is supplied by compression of the gas.

4. The apparatus described in claim 1 characterized by a gap sensor that determines the gap between the rolls of the mill, and means for changing the pressure of the hydraulic fluid in accordance with the operation of the gap sensor.

5. The apparatus described in claim 1 characterized by the obstruction having an area exposed to the hydraulic fluid in the motor cylinder, which area is substantially less than the area of the cross-section of the cylinder.

6. The apparatus described in claim 5 characterized by the obstruction being a piston that is movable in an inner cylinder located within the piston of the hydraulic motor and with one end opening into the hydraulic motor space for fluid, and the chamber being the portion of the inner cylinder in which the piston of the inner cylinder is displaced as it moves away from the end of the inner cylinder that opens into the fluid space of the hydraulic motor.

7. The apparatus described in claim 6 characterized by the motor cylinder being the movable element of the hydraulic motor, and the obstruction piston being the movable element in the inner cylinder.

8. The apparatus described in claim 6 characterized by the obstruction piston being cylindrical and of smaller diameter at its end that faces the fluid space of the hydraulic motor, and the obstruction piston being of larger diameter some distance back from its end that faces the fluid space of the hydraulic cylinder, a shoulder in the inner cylinder, said shoulder being in position to limit the extent of movement of the obstruction piston toward the cylinder head of the hydraulic motor, and a seal for hydraulic fluid located along the length of the inner cylinder between the shoulder and the end of the inner cylinder that communicates with the hydraulic motor.

9. The apparatus described in claim 6 characterized by the inner cylinder being closed at its end remote from the hydraulic cylinder, and means for admitting gas under pressure into the space between the piston in the inner cylinder and the closed end of said inner cylinder.

10. The apparatus described in claim 1 characterized by the obstruction having an area exposed to the hydraulic fluid, which area is smaller than the area of the obstruction exposed to the pressure of the gas, whereby the gas pressure has a mechanical advantage in holding the obstruction against the pressure of the fluid in the hydraulic motor.

11. The apparatus described in claim 1 characterized by the stroke of the hydraulic motor being limited to less than about ½ inch and having minimum head clearance to limit the volume of hydraulic fluid in the hydraulic motor so that the volume of fluid is substantially incompressible, and the volume of gas behind the obstruction being substantially greater than the volume of hydraulic fluid to provide for compression of the gas behind the obstruction without excessive increase in the pressure of the gas.

12. The apparatus described in claim 1 characterized by the obstruction being a movable wall exposed on one side to the hydraulic fluid and on the other side to a compressible gas in a closed space behind the wall, the chamber being the space left by movement of the obstruction away from a position that it occupies during the normal operation of the hydraulic motor.

13. The apparatus described in claim 8 characterized by there being seals along the wall of the inner cylinder on both sides of the shoulder so that the region of the shoulder is sealed against both the hydraulic fluid and the pressure of the gas.

* * * * *